US012550947B2

(12) United States Patent
Janson et al.

(10) Patent No.: US 12,550,947 B2
(45) Date of Patent: Feb. 17, 2026

(54) AEROSOL GENERATING DEVICE

(71) Applicant: JT International SA, Geneva (CH)

(72) Inventors: Olaf Janson, Steinhagen (DE); Alec Wright, Guildford (GB); Anna Polikeit, Schweich-Issel (DE); Stella Foaleng, Montherod (CH)

(73) Assignee: JT International SA (CH)

( * ) Notice: Subject to any disclaimer, the term of this patent is extended or adjusted under 35 U.S.C. 154(b) by 420 days.

(21) Appl. No.: 17/925,171

(22) PCT Filed: May 12, 2021

(86) PCT No.: PCT/EP2021/062675

§ 371 (c)(1),
(2) Date: Nov. 14, 2022

(87) PCT Pub. No.: WO2021/228968

PCT Pub. Date: Nov. 18, 2021

(65) Prior Publication Data

US 2023/0180853 A1 Jun. 15, 2023

(30) Foreign Application Priority Data

May 15, 2020 (EP) ..... 20175099

(51) Int. Cl.
*A24F 40/85* (2020.01)
*A24F 40/20* (2020.01)
(Continued)

(52) U.S. Cl.
CPC ..... *A24F 40/85* (2020.01); *A24F 40/20* (2020.01); *A24F 40/40* (2020.01); *A24F 40/46* (2020.01);
(Continued)

(58) Field of Classification Search
None
See application file for complete search history.

(56) References Cited

U.S. PATENT DOCUMENTS

2018/0049472 A1* 2/2018 Mahler ..... A24F 40/46
2018/0168224 A1 6/2018 Naughton et al.
(Continued)

FOREIGN PATENT DOCUMENTS

EP 3711525 A1 * 9/2020 ..... A24F 40/85
JP 20180522551 A 8/2018
(Continued)

OTHER PUBLICATIONS

International Search Report for Application No. PCT/EP2021/062675 mailed Jul. 9, 2021, pp. 1-4.

*Primary Examiner* — Philip Y Louie
*Assistant Examiner* — Madeleine P Delacruz
(74) *Attorney, Agent, or Firm* — Lerner David LLP

(57) ABSTRACT

An aerosol generating device includes a heating chamber for receiving an aerosol generating substrate, a heater for heating an aerosol generating substrate positioned in the heating chamber, and a debris collector. The debris collector is movable between a first position in which the debris collector is configured to collect debris generated inside the heating chamber during heating of an aerosol generating substrate by the heater and a second position in which the debris collector is configured to permit the removal or release of collected debris.

17 Claims, 5 Drawing Sheets

(51) Int. Cl.

| | |
|---|---|
| ***A24F 40/40*** | (2020.01) |
| ***A24F 40/46*** | (2020.01) |
| ***A24F 40/50*** | (2020.01) |
| ***A24F 40/53*** | (2020.01) |
| ***A24F 40/57*** | (2020.01) |
| ***A24F 40/60*** | (2020.01) |

(52) U.S. Cl.
CPC ..... *A24F 40/50* (2020.01); *A24F 40/53* (2020.01); *A24F 40/60* (2020.01); *A24F 40/57* (2020.01)

(56) References Cited

U.S. PATENT DOCUMENTS

| | | | | |
|---|---|---|---|---|
| 2019/0192810 | A1 | 6/2019 | Trzecieski | |
| 2020/0245681 | A1 | 8/2020 | An | |
| 2021/0112878 | A1* | 4/2021 | Ruscio | A24F 40/85 |
| 2022/0338553 | A1* | 10/2022 | Bologna | A24F 40/85 |

FOREIGN PATENT DOCUMENTS

| | | | |
|---|---|---|---|
| JP | 2019518421 | A | 7/2019 |
| JP | 2020536528 | A | 12/2020 |
| JP | 2021503886 | A | 2/2021 |
| JP | 2021506261 | A | 2/2021 |
| WO | 2017194766 | A1 | 11/2017 |
| WO | 2019101947 | A1 | 5/2019 |
| WO | 2019121811 | A1 | 6/2019 |
| WO | 2019198933 | A1 | 10/2019 |

* cited by examiner

AEROSOL GENERATING DEVICE

CROSS-REFERENCE TO RELATED APPLICATIONS

The present application is a national phase entry under 35 U.S.C. § 371 of International Application No. PCT/EP2021/062675, filed May 12, 2021, published in English, which claims priority to European Application No. 20175099.9 filed May 15, 2020, the disclosures of which are incorporated herein by reference.

TECHNICAL FIELD

The present disclosure relates generally to an aerosol generating device, and more particularly to an aerosol generating device for heating an aerosol generating substrate to generate an aerosol for inhalation by a user. The present disclosure is particularly applicable to a portable (hand-held) aerosol generating device, which may be self-contained and low temperature.

TECHNICAL BACKGROUND

The popularity and use of reduced-risk or modified-risk devices (also known as vaporisers) has grown rapidly in recent years as an alternative to the use of traditional tobacco products. Various devices and systems are available that heat or warm aerosol generating substances to generate an aerosol for inhalation by a user.

A commonly available reduced-risk or modified-risk device is the heated substrate aerosol generating device, or so-called heat-not-burn device. Devices of this type generate an aerosol or vapour by heating an aerosol generating substrate to a temperature typically in the range 150° C. to 300° C. Heating the aerosol generating substrate to a temperature within this range, without burning or combusting the aerosol generating substrate, generates a vapour which typically cools and condenses to form an aerosol for inhalation by a user of the device.

Even when the aerosol generating substrate is heated to a relatively low temperature, for example within the temperature range mentioned above, debris can be generated as a consequence of the heating. If the debris is allowed to accumulate within the aerosol generating device, the operation of the aerosol generating device can be impaired.

There is, therefore, a need to provide an aerosol generating device which mitigates one or more of the abovementioned drawbacks.

SUMMARY OF THE DISCLOSURE

According to a first aspect of the present disclosure, there is provided an aerosol generating device comprising:

- a heating chamber for receiving an aerosol generating substrate;
- a heater for heating an aerosol generating substrate positioned in the heating chamber; and
- a debris collector movable between a first position in which the debris collector is configured to collect debris generated inside the heating chamber during heating of an aerosol generating substrate by the heater and a second position in which the debris collector is configured to permit the removal or release of collected debris.

The aerosol generating device is adapted to heat the aerosol generating substrate, without burning the aerosol generating substrate, to volatise at least one component of the aerosol generating substrate and thereby generate a vapour which cools and condenses to form an aerosol for inhalation by a user of the aerosol generating device. The aerosol generating device is a hand-held, portable, device.

In general terms, a vapour is a substance in the gas phase at a temperature lower than its critical temperature, which means that the vapour can be condensed to a liquid by increasing its pressure without reducing the temperature, whereas an aerosol is a suspension of fine solid particles or liquid droplets, in air or another gas. It should, however, be noted that the terms 'aerosol' and 'vapour' may be used interchangeably in this specification, particularly with regard to the form of the inhalable medium that is generated for inhalation by a user.

The debris collector facilitates the collection of debris (e.g. dust and/or dirt) which can be generated inside the heating chamber during use of the aerosol generating device due to heating of the aerosol generating substrate. Debris is reliably collected when the debris collector is in the first position and collected debris can be easily removed or released simply by moving the debris collector from the first position to the second position. By collecting and removing debris from the heating chamber in a simple manner using the debris collector, the build-up of debris and deposits inside the heating chamber is minimised. Any debris and deposits that remain inside the heating chamber may have a tendency to cause overheating during use of the device, and removal of the debris and deposits thus increases the operational life of the component parts of the aerosol generating device, such as the heater and power source (e.g. battery). Further, cleaning of the aerosol generating device can be accomplished easily and conveniently, without the need to use additional cleaning tools or accessories.

The heating chamber may include one or more side walls. The heating chamber may include a first end having an opening for receiving the aerosol generating substrate. The heating chamber may include a second end opposite to the first end. The heater may be positioned between the first end and second end of the heating chamber. The aerosol generating substrate is inserted into the heating chamber via the opening at the first end. The aerosol generating substrate may form part of an aerosol generating article. At least part of the aerosol generating article may project from the opening at the first end when the aerosol generating substrate is fully inserted into the heating chamber.

When the debris collector is in the first position, the debris collector may form part of the one or more side walls of the heating chamber and/or may form part of a closure at the second end of the heating chamber. Thus, the debris collector forms part of the heating chamber and allows debris to be reliably collected at the second end.

The debris collector may be positioned at the second end of the heating chamber. The debris collector may be positioned at the second end of the heating chamber when the debris collector is in the first position. The debris collector may be configured to close the second end of the heating chamber when the debris collector is in the first position. During use of the aerosol generating device, a user typically orients the device such that the second end of the heating chamber is in a downward and/or distal position with respect to the user's mouth and such that the first end is in an upward and/or a proximate position with respect to the user's mouth. Thus, the second end of the heating chamber is typically positioned lower than the first end during use of the aerosol generating device. Thus, debris generated during use of the aerosol generating device tends to fall to the second end of the heating chamber due to the effect of gravity, and the debris is thereby reliably collected by the debris collector positioned at the second end of the heating chamber.

The debris collector may be removably mounted on the heating chamber such that the debris collector can be separated from the heating chamber when moved from the first position to the second position. Such an arrangement facilitates easy removal of debris from the debris collector when the debris collector is in the second position, separated from the heating chamber.

The debris collector may be mounted on the heating chamber when the debris collector is in both the first position and the second position. Thus, the debris collector may be permanently mounted on the heating chamber. Such an arrangement ensures that the heating chamber cannot be accidentally detached from the aerosol generating device and lost by a user when removing or releasing debris from the debris collector.

The aerosol generating device may have a longitudinal axis.

In an embodiment, the debris collector may be movable between the first position and the second position in a direction substantially parallel to the longitudinal axis. The debris collector may be slidable between the first position and the second position in a direction substantially parallel to the longitudinal axis, for example along a linear guide track. Thus, movement of the debris collector between the first and second positions may be easily accomplished by a user and collected debris may be easily removed or released when the debris collector is in the second position.

In an embodiment, the debris collector may be movable between the first position and the second position by one or both of a transverse movement and a rotational movement relative to the longitudinal axis. The debris collector may be mounted on the heating chamber by one or both of a guide track and a pivotal mounting to permit one or both of said transverse movement and said rotational movement. Thus, movement of the debris collector between the first and second positions may be easily accomplished by a user and collected debris may be easily removed or released when the debris collector is in the second position.

The debris collector may be configured to be switched between a locked state in which movement of the debris collector from the first position to the second position is prevented and an unlocked state in which movement of the debris collector from the first position to the second position is permitted. It may, for example, be advantageous for the debris collector to be in the locked state during use of the aerosol generating device to ensure that debris is reliably collected and to ensure that the debris collector cannot be inadvertently moved from the first position to the second position, thus impairing its function.

The aerosol generating device may include a controller. The aerosol generating device may include a user interface for controlling the operation of the aerosol generating device via the controller.

The controller may be configured to switch the debris collector between the locked state and the unlocked state. The controller may be configured to switch the debris collector from the unlocked state to the locked state when use of the aerosol generating device is initiated. The controller may be configured to detect the initiation of use of the aerosol generating device in response to a user input, such as a button press to activate the device, or in response to a detected airflow through the aerosol generating device. As will be understood by one of ordinary skill in the art, an airflow through the device is indicative of a user inhalation or 'puff'. The aerosol generating device may, for example, include a puff detector, such as an airflow sensor, to detect an airflow through the device. These arrangements conveniently ensure that the debris collector is locked when of use of the aerosol generating device commences, the locking being automatic in the sense that it is performed by the controller without the user having to perform a separate locking step which may be inadvertently missed or forgotten. The ease of use of the aerosol generating device is thereby enhanced.

In an embodiment, the controller may be configured to switch the debris collector from the locked state to the unlocked state after a predetermined period of time has elapsed. For example, the start of the predetermined period of time may be determined by the controller as the time at which the use of the aerosol generating device is initiated. Thus, the start of the predetermined period of time may be initiated in response to a user input, such as a button press to activate the device or an input via the user interface, or in response to a detected airflow through the aerosol generating device, for example a first puff by a user. The predetermined period of time could be periodic, in other words could be reproducible at regular time intervals. These arrangements conveniently ensure that the debris collector is unlocked automatically without user intervention, in the sense that the unlocking is performed by the controller without the user having to perform a separate unlocking step. The ease of use of the aerosol generating device is thereby further enhanced.

The aerosol generating device may include a mechanical lock which may be configured for operation by a user to switch the debris collector from the locked state to the unlocked state. The locking and unlocking of the debris collector can be performed easily and conveniently by a user of the device by a manual operation.

The debris collector may be configured to be retained in the locked state when the temperature proximate the debris collector is greater than or equal to a predetermined temperature. The debris collector may be configured to be switched from the locked state to the unlocked state when the temperature proximate the debris collector is less than the predetermined temperature. With this arrangement, the debris collector is unlocked, and therefore movable from the first position to the second position, only when it is sufficiently cool. Thus, a user cannot typically access the debris collector to remove or release any collected debris immediately after use of the device when the temperature is typically too high. The safety of the aerosol generating device may, thus, be improved.

The aerosol generating device may include a temperature sensor located proximate the debris collector and operatively connected to the controller, and the controller may be configured to retain the debris collector in the locked state when the temperature detected by the temperature sensor is greater than or equal to the predetermined temperature. Purely by way of non-limiting example, the predetermined temperature could be 45° C. The term "temperature sensor" is used to describe an element which is capable of determining an absolute or relative temperature of a part of the aerosol generating device, proximate the debris collector. This may include thermocouples, thermopiles, thermistors and the like. The temperature sensor may be provided as part of another component, or it may be a separate component.

The debris collector may comprise a heat-sensitive material having dimensions which vary dependent upon the temperature of the material. The heat-sensitive material may cooperate with the heating chamber and/or the device housing when the temperature proximate the debris collector is greater than or equal to the predetermined temperature to thereby maintain the debris collector in the locked state. The heat-sensitive material may optionally be a shape-memory material, such as a shape-memory alloy. When the temperature of the heat-sensitive material is greater than or equal to the predetermined temperature (as experienced during operation of the heater), it expands by a sufficient amount, for example to form an interference fit between the debris collector and the heating chamber and/or device housing and thereby retains the debris collector in the locked state. Consequently, the debris collector is retained in the locked state when its temperature is greater than or equal to the predetermined temperature. The use of a heat-sensitive, and preferably a shape-memory, material conveniently ensures that the debris collector is switched between the locked and unlocked states automatically, without user intervention, in the sense that the locking and unlocking is performed without the user having to perform separate locking and/or unlocking steps. The ease of use of the aerosol generating device is thereby enhanced without the need for a separate locking mechanism or additional control logic to perform the locking/unlocking. As will be understood by one of ordinary skill in the art, when the heater is deactivated, the aerosol generating device cools down and when it has cooled by a sufficient amount such that the temperature at the second end of the heating chamber is less than the predetermined temperature, the thermal shrinkage of the debris collector is sufficient to enable it to be removed from the heating chamber, for example because there is no longer an interference fit between the debris collector and the heating chamber and/or device housing.

The aerosol generating device may include a detector which may be configured to detect the position of the debris collector, for example to detect whether the debris collector is in the first position or another position, such as the second position. The detector may be configured to provide a first position signal to the controller when the debris collector is in the first position. The detector may be configured to provide a second position signal to the controller when the debris collector is in any position other than the first position, for example the second position. The controller may be adapted to permit operation of the heater in response to the first position signal and to prevent operation of the heater in response to the second position signal. With this arrangement, the heater can only be operated when the debris collector is in the first position, operation of the heater being prevented if the debris collector is in any other position, such as the second position. This ensures that debris is reliably collected by the debris collector at all times during use of the aerosol generating device.

The term "heater" should be understood to mean any device for outputting thermal energy sufficient to form an aerosol by heating the aerosol generating substrate. The heater may be electrically powered and may include resistive track elements (optionally including insulating packaging), induction heating systems (e.g. including an electromagnet and high frequency oscillator), etc. The heater may be arranged around the outside of the heating chamber and, hence, the aerosol generating substrate, it may penetrate part way or fully into the heating chamber and, hence, the aerosol generating substrate, or any combination of these.

The heater may comprise a resistive heater. The resistive heater may comprise a resistive heating element or may comprise the side wall(s) of the heating chamber. The resistive heating element or the side wall(s) of the heating chamber may comprise an electrically resistive material. Examples of suitable electrically resistive materials include, but are not limited to, metals, metal alloys, electrically conductive ceramics, for example tungsten and alloys thereof, and composite materials comprising a metallic material and a ceramic material.

The heater may comprise an induction coil arranged to generate an alternating electromagnetic field for inductively heating an induction heatable susceptor. The induction coil may comprise a Litz wire or a Litz cable. It will, however, be understood that other materials could be used. The induction coil may extend around the heating chamber.

The induction coil could be substantially helical in shape. The circular cross-section of a helical induction coil may facilitate the insertion of an aerosol generating substrate, or for example an aerosol generating article including the aerosol generating substrate and optionally one or more induction heatable susceptors, into the heating chamber and ensure uniform heating of the aerosol generating substrate.

The induction heatable susceptor(s) may comprise one or more, but not limited, of aluminium, iron, nickel, stainless steel and alloys thereof, e.g. Nickel Chromium or Nickel Copper. With the application of an electromagnetic field in its vicinity, the susceptor(s) may generate heat due to eddy currents and magnetic hysteresis losses resulting in a conversion of energy from electromagnetic to heat.

The induction coil may be arranged to operate in use with a fluctuating electromagnetic field having a magnetic flux density of between approximately 20 mT and approximately 2.0 T at the point of highest concentration.

The controller may include electronic circuitry. The aerosol generating device may include a power source, such as a battery. The power source and the electronic circuitry may be configured to operate at a high frequency. The power source and the electronic circuitry may be configured to operate at a frequency of between approximately 80 kHz and 500 kHz, possibly between approximately 150 kHz and 250 kHz, and possibly at approximately 200 kHz. The power source and the electronic circuitry could be configured to operate at a higher frequency, for example in the MHz range, depending on the type of inductively heatable susceptor that is used.

The aerosol generating substrate may be any type of solid or semi-solid material. Example types of aerosol generating solids include powder, granules, pellets, shreds, strands, particles, gel, strips, loose leaves, cut leaves, cut filler, porous material, foam material or sheets. The aerosol generating substrate may comprise plant derived material and in particular, may comprise tobacco. It may advantageously comprise reconstituted tobacco.

Consequently, the aerosol generation device may equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol generating substrate.

The aerosol generating substrate may be circumscribed by a paper wrapper and may, thus, be embodied as an aerosol generating article. The aerosol generating article may be formed substantially in the shape of a stick, and may broadly resemble a cigarette, having a tubular region with an aerosol generating substrate arranged in a suitable manner. The aerosol generating article may include a filter, for example comprising cellulose acetate fibres. The filter may be in abutting coaxial alignment with the aerosol generating substrate. One or more vapour collection regions, cooling regions, and other structure may also be included in some designs.

The aerosol generating substrate may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis. In some embodiments, the aerosol generating substrate may comprise an aerosol-former content of between approximately 10% and approximately 20% on a dry weight basis, and possibly approximately 15% on a dry weight basis.

Upon heating, the aerosol generating substrate may release volatile compounds. The volatile compounds may include nicotine or flavour compounds such as tobacco flavouring.

DETAILED DESCRIPTION OF EMBODIMENTS

Embodiments of the present disclosure will now be described by way of example only and with reference to the accompanying drawings.

Figure 1:
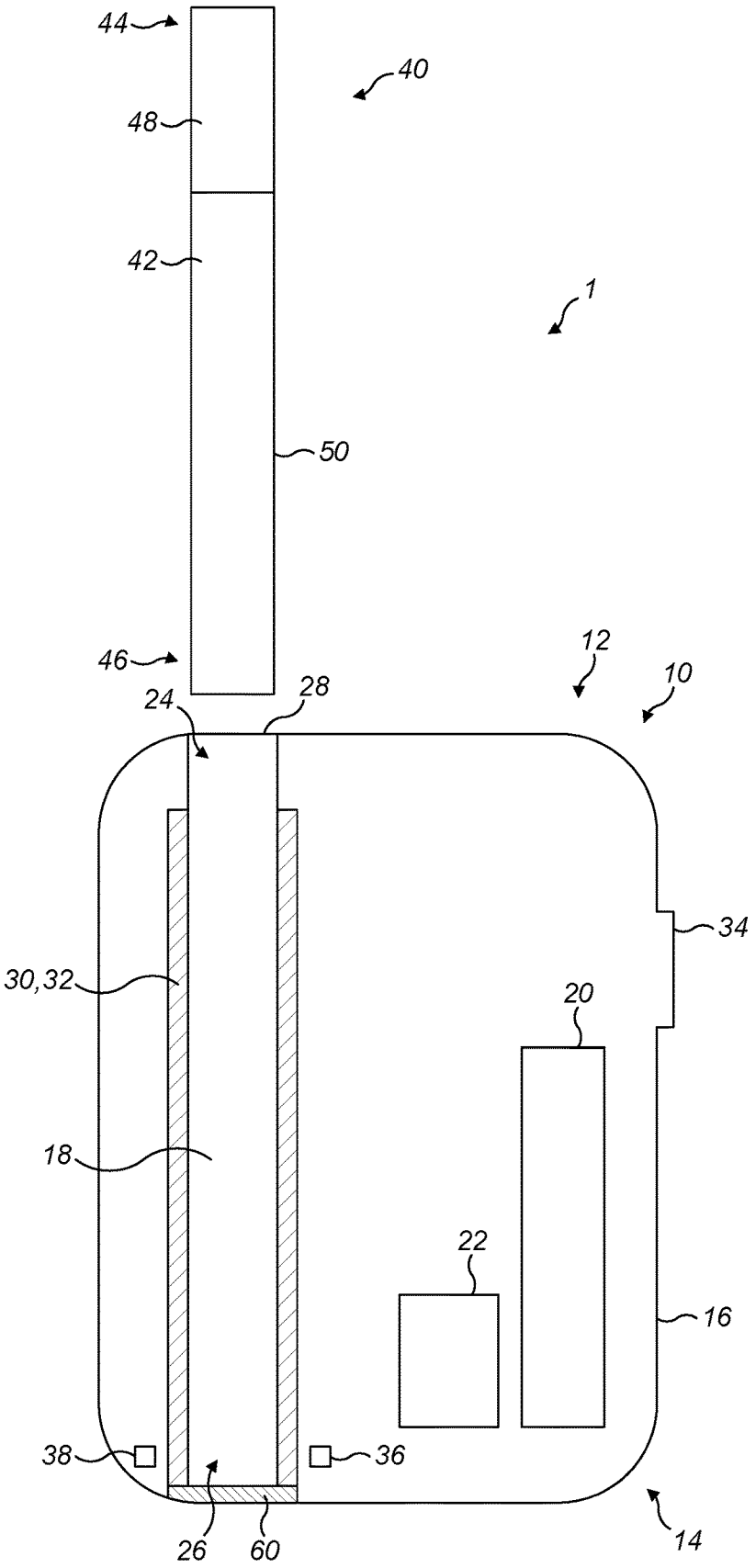
FIG. 1 is a diagrammatic cross-sectional view of an aerosol generating system comprising an aerosol generating device and an aerosol generating article.
Figure 2:
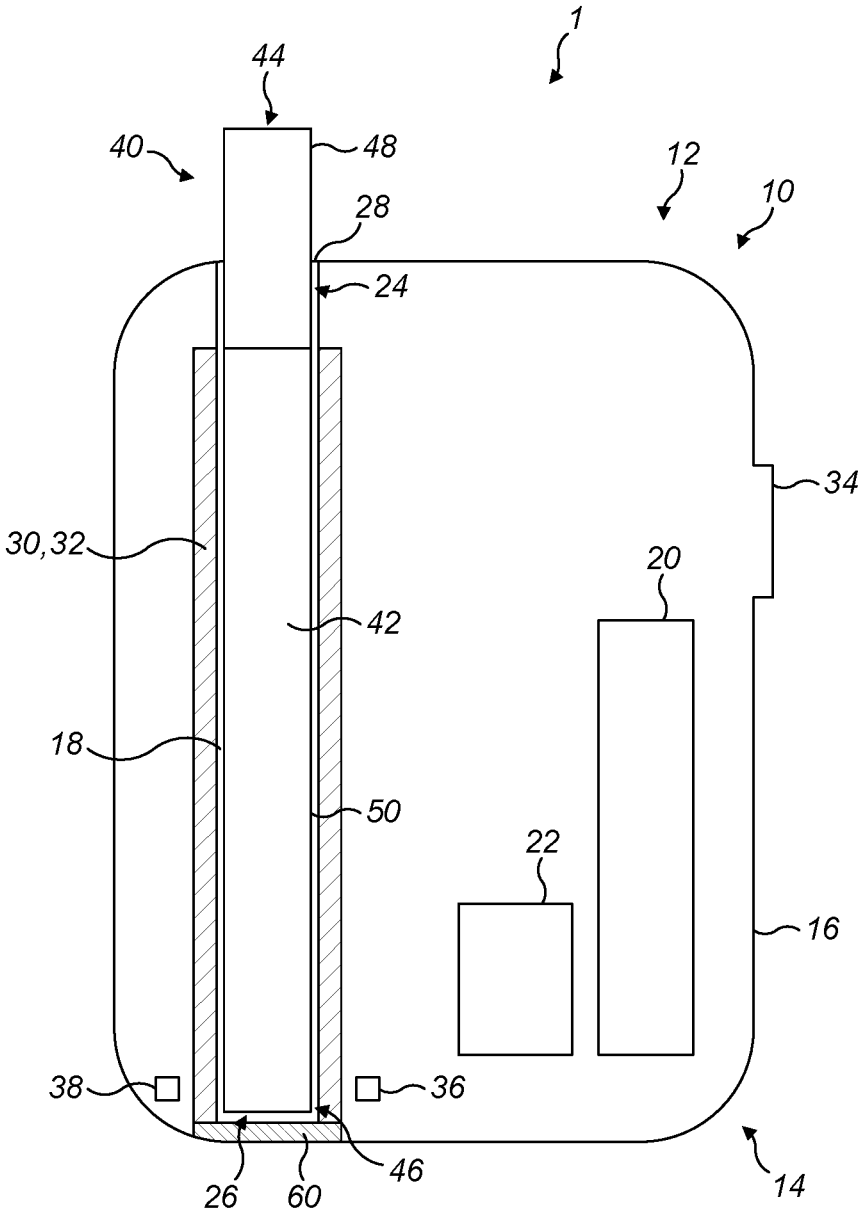
FIG. 2 is a diagrammatic cross-sectional view of the aerosol generating system of FIG. 1, showing the aerosol generating article positioned in a heating chamber of the aerosol generating device.

Referring initially to FIGS. 1 and 2, there is shown diagrammatically an example of an aerosol generating system 1. The aerosol generating system 1 comprises an aerosol generating device 10 and an aerosol generating article 40 for use with the device. The aerosol generating device 10 has a first (or proximal) end 12 and a second (or distal) end 14 and comprises a device housing 16. The aerosol generating device 10 further comprises a heating chamber 18 having a substantially cylindrical cross-section, a power source 20, for example one or more batteries, and a controller 22 which are all positioned in the device housing 16. The aerosol generating device is a hand-held, portable, device, by which it is meant that a user is able to hold and support the device unaided, in a single hand.

The heating chamber 18 has a first end 24 and a second end 26, and includes an opening 28 at the first end 24 for receiving an aerosol generating article 40. In the illustrated embodiment, the heating chamber 18 includes a substantially cylindrical side wall 30, i.e., a side wall 30 which has a substantially circular cross-section.

The heating chamber 18 is arranged to receive a correspondingly shaped generally cylindrical or rod-shaped aerosol generating article 40 comprising an aerosol generating substrate 42. The aerosol generating article 40 is a disposable and replaceable article which may, for example, contain tobacco as the aerosol generating substrate 42. The aerosol generating article 40 has a first end 44 (or mouth end), a second end 46, and comprises a filter 48 at the first end 44 which is in abutting coaxial alignment with the aerosol generating substrate 42. The filter 48 acts as a mouthpiece and comprises an air-permeable plug, for example comprising cellulose acetate fibres. Both the aerosol generating substrate 42 and the filter 48 are circumscribed by a paper wrapper 50.

In order to use the aerosol generating system 1, a user inserts an aerosol generating article 40 through the opening 28 into the heating chamber 18, so that the second end 46 of the aerosol generating article 40 is positioned at the second end 26 of the heating chamber 18 and so that the filter 48 at the first end 44 of the aerosol generating article 40 projects from the first end 24 of the heating chamber 18 to permit engagement by a user's lips.

The aerosol generating device 10 includes a heater 32 for heating the aerosol generating substrate 42 without burning the aerosol generating substrate 42. In the illustrated embodiment, the heater 32 is a resistive heater which coextends with the side wall of the heating chamber 18 and which is positioned between the first end 24 and the second end 26. Other types and configurations of heater 32 can, of course, be used as discussed earlier in this specification.

During operation of the aerosol generating system 1, an electric current is supplied to the resistive heater 32 causing it to heat up. The heat from the resistive heater 32 is transferred to the adjacent aerosol generating substrate 42 of an aerosol generating article 40 positioned in the heating chamber 18, for example by conduction, radiation and convection, to heat the aerosol generating substrate 42 and thereby generate a vapour which cools and condenses to form an aerosol for inhalation by a user of the aerosol generating system 1 through the filter 48. The vaporisation of the aerosol generating substrate 42 is facilitated by the addition of air from the surrounding environment through one or more air inlets (not shown) and/or through the opening 28.

Figure 3B:
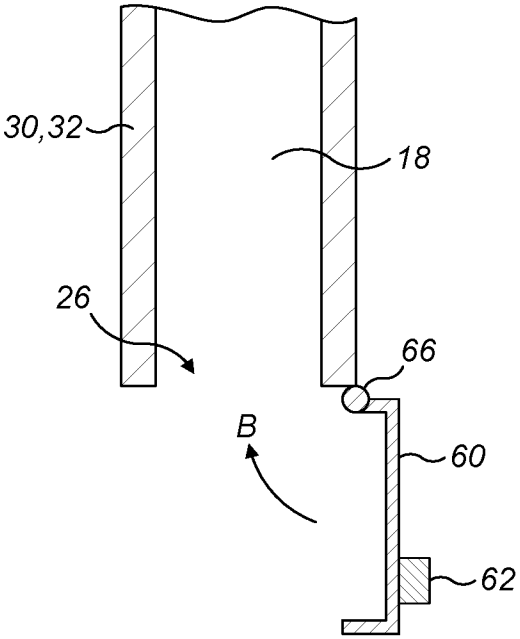
FIGS. 3*a* and 3*b* are diagrammatic cross-sectional views of a first example of a debris collector in first and second positions respectively.

The aerosol generating device 10 includes a debris collector 60 which is movable between a first position (e.g. as shown schematically in FIG. 3*a*) in which the debris collector 60 is configured to collect debris generated inside the heating chamber 18 during heating of an aerosol generating substrate 42 by the heater 32, and a second position (e.g. as shown in FIG. 3*b*) in which the debris collector 60 is configured to permit the removal or release of collected debris from the debris collector 60 and/or from the second end 26 of the heating chamber 18. The debris collector 60 is positioned at the second end 26 of the heating chamber 18 and closes the second end 26 when it is in the first position to ensure that debris cannot escape from the heating chamber 18. The debris envisaged for collection by the debris collector 60 may include, but is not limited to, dust, dirt and other deposits generated during heating of the aerosol generating substrate 42.

Figure 3A:
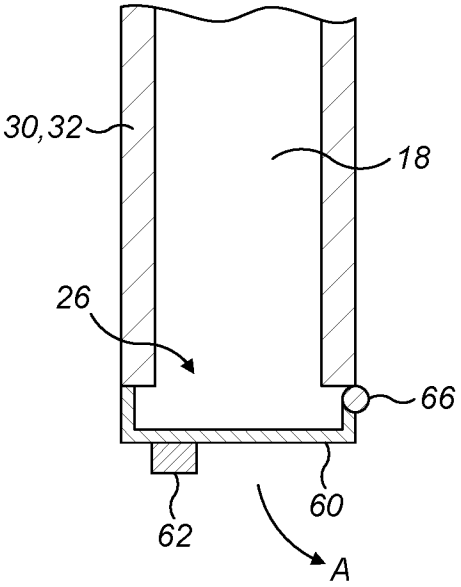

In a first example shown in FIGS. 3*a* and 3*b*, the debris collector 60 is pivotally mounted by a pivotal mounting 66 at the second end 26 of the heating chamber 18 for movement in the direction of arrow A from the first position shown in FIG. 3*a* to the second position shown in FIG. 3*b*, or conversely for movement in the direction of arrow B from the second position shown in FIG. 3*b* to the first position shown in FIG. 3*a*. When the debris collector 60 is in the first position shown in FIG. 3*a*, it forms a closure at the second end 26 of the heating chamber 18 and forms part of the side wall 30 of the heating chamber 18 at the second end 26.

As will be understood by one of ordinary skill in the art, prior to use of the aerosol generating device 10 to heat an aerosol generating article 40, the debris collector is placed by a user in the first position shown in FIG. 3*a* to close the second end 26 of the heating chamber 18. Thus, when the heater 32 is operated to heat the aerosol generating substrate 42 of an aerosol generating article 40 positioned in the heating chamber 18, dust or debris that may be generated during use of the aerosol generating device 10 is collected by the debris collector 60. During use, a user typically orients the aerosol generating device 10 with the second end 14 downward and/or in a distal position with respect to the user's mouth and the first end 12 upward and/or in a proximate position with respect to the user's mouth. Thus, any dust or debris that is generated during use of the aerosol generating device 10 tends to fall or migrate towards the second end 26 of the heating chamber 18 under the action of gravity.

In some embodiments, the debris collector 60 may be configured to be switched between a locked state in which movement of the debris collector 60 from the first position (see FIG. 3*a*) to the second position (see FIG. 3*b*) is prevented and an unlocked state in which movement of the debris collector 60 from the first position (see FIG. 3*a*) to the second position (see FIG. 3*b*) is permitted. By ensuring that the debris collector 60 is in the locked state during use of the aerosol generating device 10, it is possible to ensure that debris is reliably collected and to ensure that the debris collector 60 cannot be inadvertently moved from the first position to the second position. In this way, the inadvertent release of collected debris is prevented.

In one embodiment, the aerosol generating device 10 can include a mechanical lock 62 which is shown schematically in FIGS. 3*a* and 3*b*. The mechanical lock 62, which may for example comprise a latch (not shown) with an associated release button, can be operated by a user to switch the debris collector 60 from the locked state to the unlocked state. The latch could, for example, be biased to a locking position by a suitable biasing means.

In another embodiment, the controller 22 can be configured to switch the debris collector 60 between the unlocked state and the locked state according to the operational state of the aerosol generating device 10. In particular, the controller 22 could be configured to switch the debris collector 60 to the locked state when the use of the aerosol generating device 10 is initiated. In one example, the controller 22 could be configured to detect the initiation of use of the aerosol generating device 10 in response to a user input, such as a button press using button 34 to activate the device 10, or in response to the detection of an airflow through the aerosol generating device 10 by a puff detector, such as an airflow sensor, the airflow being indicative that a first puff is being taken by a user of the device 10. The debris collector 60 can thereby be locked automatically by the controller 22 when use of the aerosol generating device 10 commences, without the user having to perform a separate locking step or operation. The controller 22 could be configured to operate a locking mechanism, e.g. comprising a latch, to switch the debris collector 60 from the unlocked state to the locked state.

The controller 22 could be further configured to switch the debris collector 60 from the locked state to the unlocked state after a predetermined period of time has elapsed. In one example, the start of the predetermined period of time could be determined by the controller 22 as the time at which use of the aerosol generating device 10 is initiated. In other words, the start of the predetermined period of time could be initiated in response to a user input, such as a button press using button 34 to activate the device 10, or in response to a detected airflow through the aerosol generating device 10 that is indicative of a first puff by a user. The predetermined period of time could be periodic, in other words could be reproducible at regular time intervals. The debris collector 60 is thereby unlocked automatically by the controller 22 when of use of the aerosol generating device 10 ceases, for example at the end of a smoking session, without the user having to perform a separate unlocking step or operation. The controller 22 could be configured to operate the aforementioned locking mechanism to switch the debris collector 60 from the locked state to the unlocked state.

In some embodiments, it may be desirable to prevent the debris collector 60 from being switched from the locked state to the unlocked state when the temperature proximate the debris collector 60 is equal to or greater than a predetermined temperature, such as 45° C. The aerosol generating device 10 may, therefore, include a temperature sensor 36 located in the vicinity of the second end 26 of the heating chamber 18 close to the debris collector 60. The temperature sensor 36 is operatively connected to the controller 22 so that the controller 22 receives a temperature signal from the temperature sensor 36 and so that the controller 22 can retain the debris collector 60 in the locked state when the detected temperature is greater than or equal to the predetermined temperature.

In some embodiments, it may be desirable to prevent the heater 32 of the aerosol generating device 10 from being operated unless the debris collector 60 is in the first position. The aerosol generating device 10 may, therefore, include a detector 38 located in the vicinity of the second end 26 of the heating chamber 18, proximate the debris collector 60. The detector 38 is operatively connected to the controller 22 and is configured to detect the position of the debris collector 60, in particular to detect whether the debris collector 60 is in the first position shown in FIG. 3*a* or in another position, such as the second position shown in FIG. 3*b*. The detector 38 can be configured to provide a first position signal to the controller 22 when the debris collector 60 is in the first position and to provide a second position signal to the controller 22 when the debris collector 60 is in any position other than the first position, for example the second position. The controller 22 is adapted to permit operation of the heater 32 in response to the first position signal, for example by controlling the power source 20 to supply electrical current to the heater 32, and is adapted to prevent operation of the heater 32 in response to the second position signal, for example by controlling the power source 20 so that electrical current is not supplied to the heater 32.

Figure 4B:
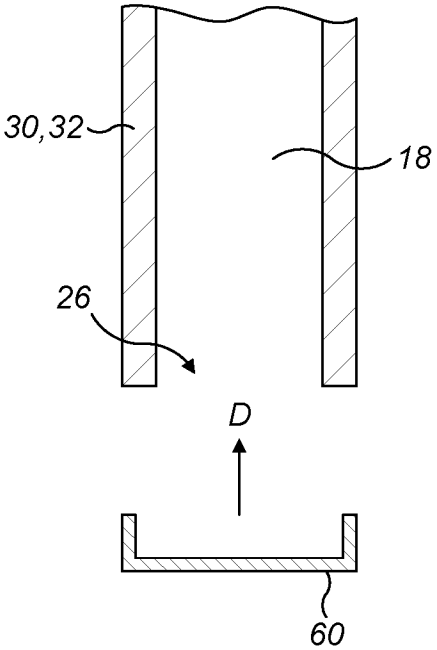
FIGS. 4*a* and 4*b* are diagrammatic cross-sectional views of a second example of a debris collector in first and second positions respectively.
Figure 4A:
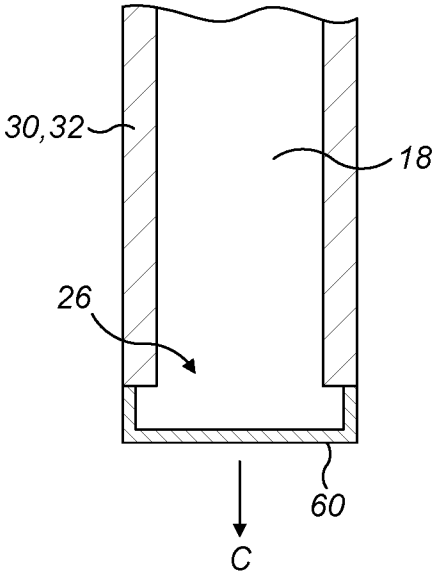

Referring now to FIGS. 4*a* and 4*b*, in a second example the debris collector 60 is removably mounted, as a separate component part, at the second end 26 of the heating chamber 18 for movement in the direction of arrow C from the first position shown in FIG. 4*a* to remove it from the heating chamber 18. In this example, the debris collector 60 can be moved in a direction substantially parallel to a longitudinal direction of the aerosol generating device 10 to move it from the first position and thereby separate it from the heating chamber 18. Conversely, the debris collector 60 can be reattached to the heating chamber 18, for example by moving it to the first position in the direction of arrow D in FIG. 4*b*.

Figure 5B:
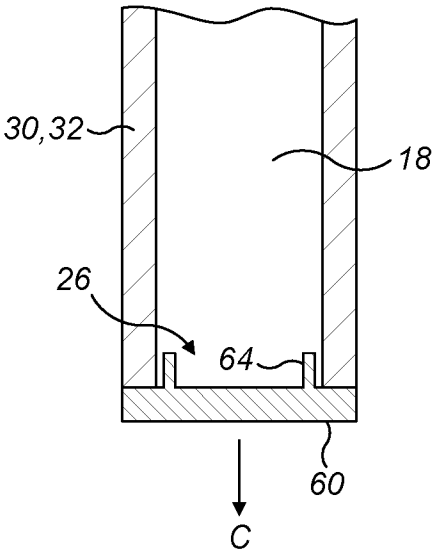
FIGS. 5*a* and 5*b* are diagrammatic cross-sectional views of a third example of a debris collector in first and second positions respectively.
Figure 5A:
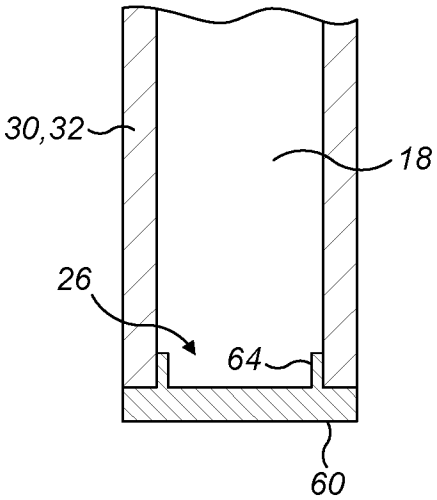

Referring now to FIGS. 5*a* and 5*b*, in a third example the debris collector 60 comprises a heat-sensitive material, for example a shape-memory material such as a shape-memory alloy. The heat-sensitive material is selected so that when the temperature proximate the debris collector 60 is equal to or greater than a predetermined temperature, such as 45° C., the debris collector 60 undergoes a thermal expansion such that at least part of the debris collector 60, for example a circular rim 64, cooperates with the heating chamber 18 to form an interference fit. Thus, when the heater 32 of the aerosol generating device 10 is operated during use of the device 10, the thermal expansion experienced by the debris collector 60 ensures that it is retained in the locked state and, thus, that it cannot move from the first position shown in FIG. 5*a*. After use of the aerosol generating device 10 has ended and the temperature at the second end 26 of the heating chamber 18 has decreased by a sufficient amount so that it is less than the predetermined temperature, the thermal expansion of the debris collector 60 is reversed by a sufficient amount that the circular rim 64 moves away from the heating chamber 18, thereby releasing the interference fit and enabling the debris collector 60 to be moved from the first position shown in FIG. 5*a*, in the direction of arrow C in FIG. 5*b* to a position in which collected debris can be removed or released.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating device comprising:

a heating chamber for receiving an aerosol generating substrate, the heating chamber including:

one or more side walls, a first end having an opening for receiving the aerosol generating substrate, and a second end opposite the first end;

a heater for heating an aerosol generating substrate positioned in the heating chamber; and a debris collector movable between a first position in which the debris collector is configured to collect debris generated inside the heating chamber during heating of an aerosol generating substrate by the heater and a second position in which the debris collector is configured to permit removal or release of collected debris, the debris collector is moveable between the first position and the second position by a rotational movement relative to a longitudinal axis of the aerosol generating device, wherein, when in the first position, the debris collector is attached to the second end of the heating chamber.

2. The aerosol generating device according to claim 1, wherein when the debris collector is in the first position, the debris collector forms part of the one or more side walls, or forms part of a closure at the second end, or forms part of the one or more side walls and a closure at the second end.

3. The aerosol generating device according to claim 2, wherein the debris collector is positioned at the second end of the heating chamber when the debris collector is in the first position.

4. The aerosol generating device according to claim 3, wherein the debris collector is configured to close the second end of the heating chamber when the debris collector is in the first position.

5. The aerosol generating device according to claim 1, wherein the debris collector is removably mounted on the heating chamber such that the debris collector is separated from the heating chamber when moved from the first position to the second position.

6. The aerosol generating device according to claim 1, wherein the debris collector is mounted on the heating chamber when the debris collector is in both the first position and the second position.

7. The aerosol generating device according to claim 1, wherein the aerosol generating device has a longitudinal axis, and the debris collector is movable between the first position and the second position in a direction substantially parallel to the longitudinal axis.

8. The aerosol generating device according to claim 1, wherein the aerosol generating device has a longitudinal axis, and the debris collector is movable between the first position and the second position by a transverse movement and the rotational movement relative to the longitudinal axis.

9. The aerosol generating device according to claim 1, wherein the debris collector is mounted on the heating chamber by the rotational movement.

10. The aerosol generating device according to claim 9, wherein the debris collector is further mounted on the heating chamber by a guide track to permit transverse movement.

11. The aerosol generating device according to claim 1, wherein the debris collector is configured to be switched between a locked state in which movement of the debris collector from the first position to the second position is prevented and an unlocked state in which movement of the debris collector from the first position to the second position is permitted.

12. The aerosol generating device according to claim 11, further comprising a controller configured to switch the debris collector from the locked state to the unlocked state after a predetermined period of time has elapsed.

13. The aerosol generating device according to claim 11, further comprising a mechanical lock configured for operation by a user to switch the debris collector from the locked state to the unlocked state.

14. The aerosol generating device according to claim 11, wherein the debris collector is configured to be retained in the locked state when a temperature proximate the debris collector is greater than or equal to a predetermined temperature, and the debris collector is configured to be switched from the locked state to the unlocked state when the temperature proximate the debris collector is less than the predetermined temperature.

15. The aerosol generating device according to claim 14, wherein the debris collector comprises a heat-sensitive material having dimensions which vary dependent upon material temperature, and the heat-sensitive material cooperates with the heating chamber when the temperature proximate the debris collector is greater than or equal to the predetermined temperature to thereby maintain the debris collector in the locked state.

16. The aerosol generating device according to claim 15, wherein the heat-sensitive material is a shape-memory material.

17. The aerosol generating device according to claim 1, further comprising a controller and a detector configured to detect a position of the debris collector and to provide a first position signal or a second position signal to the controller corresponding respectively to the first position or another position of the debris collector, wherein the controller is adapted to permit operation of the heater in response to the first position signal and to prevent operation of the heater in response to the second position signal.

* * * * *